US006717122B2

(12) United States Patent
Roh

(10) Patent No.: US 6,717,122 B2
(45) Date of Patent: Apr. 6, 2004

(54) WALL-MOUNTED MICROWAVE OVEN AND STRUCTURE FOR REMOVING MAGNETRON

(75) Inventor: Gun-Young Roh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/105,165

(22) Filed: Mar. 26, 2002

(65) Prior Publication Data

US 2003/0106893 A1 Jun. 12, 2003

(30) Foreign Application Priority Data

Dec. 8, 2001 (KR) ..... 2001-77569

(51) Int. Cl.[7] ..... H05B 6/66

(52) U.S. Cl. ..... 219/756; 219/761; 219/720; 219/757; 126/275 E

(58) Field of Search ..... 219/756, 757, 219/761, 702, 720; 126/275 E, 273 A

(56) References Cited

U.S. PATENT DOCUMENTS

| | | | | |
|---|---|---|---|---|
| 4,609,801 A | | 9/1986 | Spencer et al. | |
| 4,618,756 A | | 10/1986 | Schwaderer et al. | |
| 5,739,736 A | * | 4/1998 | Lee | 219/760 |
| 5,886,328 A | | 3/1999 | Yun | |
| 6,239,419 B1 | | 5/2001 | Kim | 219/757 |
| 6,278,099 B1 | | 8/2001 | Kang | |
| 6,291,809 B1 | | 9/2001 | Ha | 219/757 |
| 6,414,287 B2 | * | 7/2002 | Han et al. | 219/756 |
| 2001/0025849 A1 | | 10/2001 | Han et al. | |
| 2001/0026822 A1 | * | 10/2001 | Lee et al. | 426/241 |

FOREIGN PATENT DOCUMENTS

| | | | | |
|---|---|---|---|---|
| GB | 2 200 019 | * | 7/1998 | 219/756 |
| JP | 1-302684 | * | 12/1989 | 219/757 |
| KR | 2001-060661 | * | 7/2001 | |

OTHER PUBLICATIONS

International Search Report and Annex.

* cited by examiner

*Primary Examiner*—Philip H. Leung
(74) *Attorney, Agent, or Firm*—Staas & Halsey

(57) ABSTRACT

A wall-mounted microwave oven includes a body partitioned into a cooking cavity and a machine room, a magnetron detachably installed in the machine room, and a control panel detachably mounted on the body in front of the machine room. The magnetron is mounted on a bottom surface of the machine room so as to allow an operator to repair or replace the magnetron without removing the wall-mounted microwave oven from a wall.

19 Claims, 5 Drawing Sheets

WALL-MOUNTED MICROWAVE OVEN AND STRUCTURE FOR REMOVING MAGNETRON

CROSS-REFERENCE TO RELATED APPLICATIONS

This application claims the benefit of Korean Application No. 2001-77569, filed Dec. 8, 2001, in the Korean Industrial Property Office, the disclosure of which is incorporated herein by reference.

BACKGROUND OF THE INVENTION

1. Field of the Invention

The present invention relates to a wall-mounted microwave oven, and more particularly, to a wall-mounted microwave oven which allows a user to easily repair and replace a magnetron installed in a machine room of the wall-mounted microwave oven.

2. Description of the Related Art

Generally, a wall-mounted microwave oven is installed above, for example, an oven range, and serves to exhaust gas and smoke produced from an operation of the oven range positioned under the wall-mounted microwave oven, in addition to its original function of cooking foods.

FIG. 1 shows that a conventional wall-mounted microwave oven is designed so as to have a rear surface of a body 1 fixed to a wall 100 of a building. The body 1 is partitioned into a cooking cavity (not shown) and a machine room 3 which receives various electrical parts therein. An exhaust path 4 is formed along both a lower portion of the body 1 and a rear portion of the machine room 3 in order to exhaust gas and smoke produced from the oven range (not shown) positioned under the wall-mounted microwave oven. An exhaust fan 5 is installed on an upper portion of the rear surface of the body 1. Such a construction allows the gas and smoke produced by the oven range to exhaust to the atmosphere as the exhaust fan 5 is operated.

A control panel 6 is mounted on a front surface of the machine room 3, and provided with a plurality of buttons (not shown) which control the operation of the wall-mounted microwave oven. Similarly to the construction of general microwave ovens, a variety of electrical parts, for example, a magnetron 7, a high voltage transformer 8, a high voltage condenser 9 and a cooling fan 10 are installed in the machine room 3. In this case, the magnetron 7 is mounted on an upper wall of the machine room 3. A waveguide duct 11 is installed on the outside of the upper wall of the machine room 3 so as to guide high-frequency electromagnetic waves from the magnetron 7 to the cooking cavity (not shown). The high voltage transformer 8 is mounted on a bottom wall of the machine room 3, and the high voltage condenser 9 is mounted in the rear portion of the machine room 3. The cooling fan 10 is installed on a support plate 10*a* which partitions the machine room 3 into front and rear chambers, and forms a path which sucks atmospheric air into the machine room 3. A suction grille 12 is formed on the front surface of the machine room 3 at a position above the control panel 6, and cools the parts inside the machine room 3 with air flowing into the machine room 3 as the cooling fan 10 is operated.

During an operation of such a conventional wall-mounted microwave oven, parts inside the machine room 3 frequently malfunction, requiring them to be repaired or replaced with new ones. Of these parts, the magnetron 7 which generates the high-frequency electromagnetic waves malfunctions more frequently than the other parts inside the machine room 3.

With a conventional wall-mounted microwave oven, it is difficult to repair or replace the magnetron 7 because the body 1 is fixed to the wall 100 of a building, and the magnetron 7 is mounted on the upper wall of the machine room 3. In addition, the wall-mounted microwave oven has a complicated structure as compared to general type microwave ovens.

To repair or replace the magnetron 7 of a conventional wall-mounted microwave oven, the body 1 has to be removed from the wall 100 of the building and then completely disassembled into parts. Therefore, repairing and/or replacing parts in a conventional wall-mounted microwave oven is difficult and inconvenient.

SUMMARY OF THE INVENTION

Accordingly, it is an object of the present invention to provide a wall-mounted microwave oven which allows parts, such as a magnetron to be repaired or replaced without removing a body of the wall-mounted microwave oven from a wall.

Additional objects and advantages of the invention will be set forth in part in the description which follows, and, in part, will be obvious from the description, or may be learned by practice of the invention.

To achieve the above and other objects of the present invention, there is provide a wall-mounted microwave oven comprising a body which is mounted on a wall and partitioned into a cooking cavity and a machine room, a magnetron which generates high-frequency electromagnetic waves and installed in the machine room, and a control panel which is detachably mounted on the body in front of the machine room, wherein the magnetron is mounted on a bottom surface of the machine room so as to be removable from the machine room without removing the body from the wall.

According to an aspect of the present invention, the wall-mounted microwave oven is provided with fastening means which is tightened or loosened from the outside of a lower end of the body so as to removably mount the magnetron.

According to another aspect of the present invention, a cover plate is detachably attached to the lower end of the body and spaced apart from the bottom surface of the machine room.

According yet another aspect of the present invention, a cooling fan assembly is installed in the machine room and an opening is formed on a front surface of the body at a position behind the control panel, so as to allow machine room components including the cooling fan assembly and the magnetron to be taken out from the machine room through the opening.

According to still another aspect of the present invention, a waveguide duct is provided to extend from the bottom surface of the machine room at a position under the magnetron to a bottom surface of the cooking cavity so as to guide the high-frequency electromagnetic waves from the magnetron to the cooking cavity.

BRIEF DESCRIPTION OF THE DRAWINGS

The above and other objects, features and advantages of the present invention will become more apparent and more readily appreciated by describing in detail preferred embodiments thereof with reference to the accompanying drawings in which.

DESCRIPTION OF THE PREFERRED EMBODIMENTS

Figure 1:
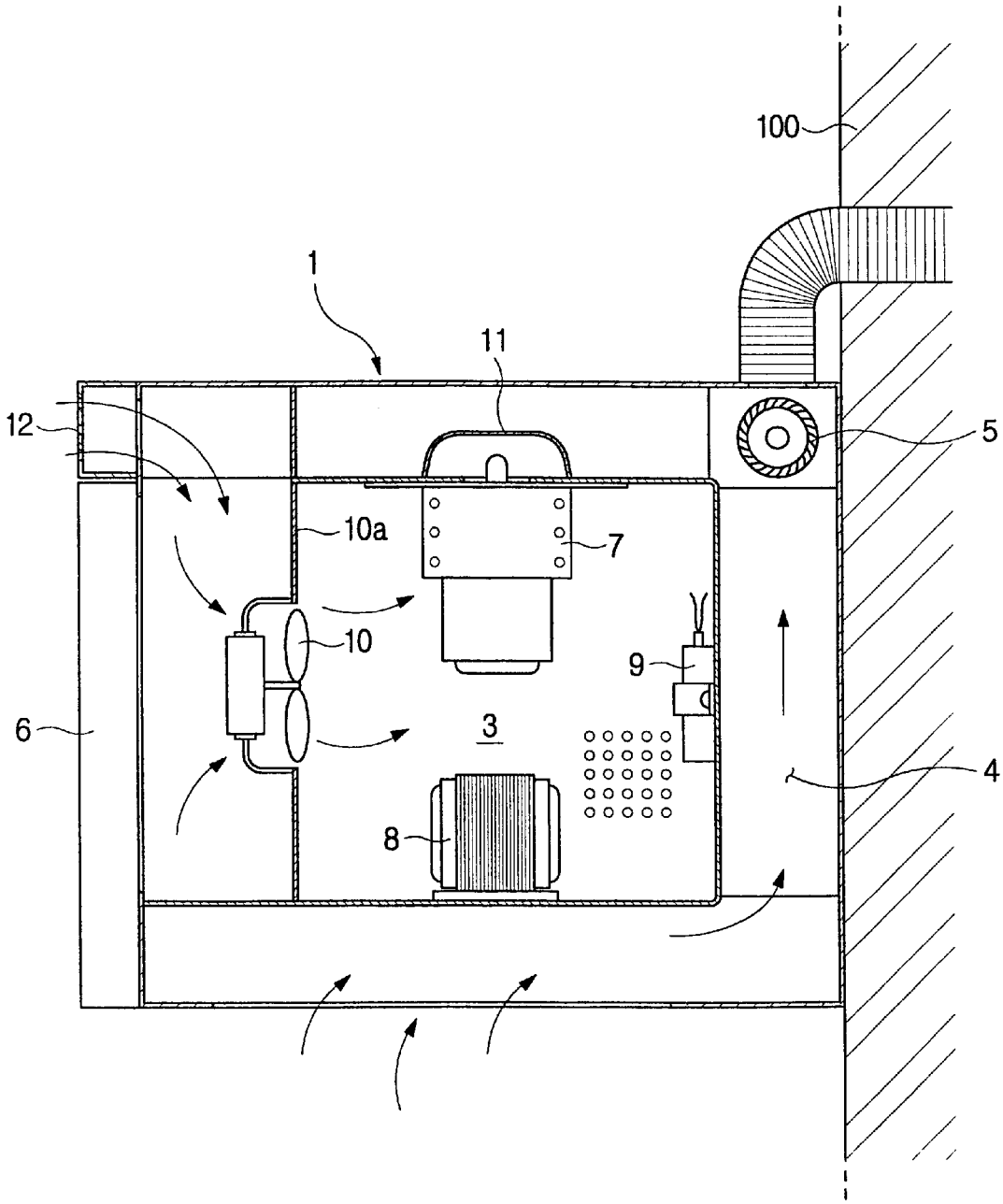
FIG. 1 (PRIOR ART)
FIG. 1 is a side sectional view showing the construction of a machine room of a conventional wall-mounted microwave oven.

Reference will now be made in detail to the present preferred embodiments of the present invention, examples of which are illustrated in the accompanying drawings, wherein like reference numerals refer to like elements throughout.

Figure 2:
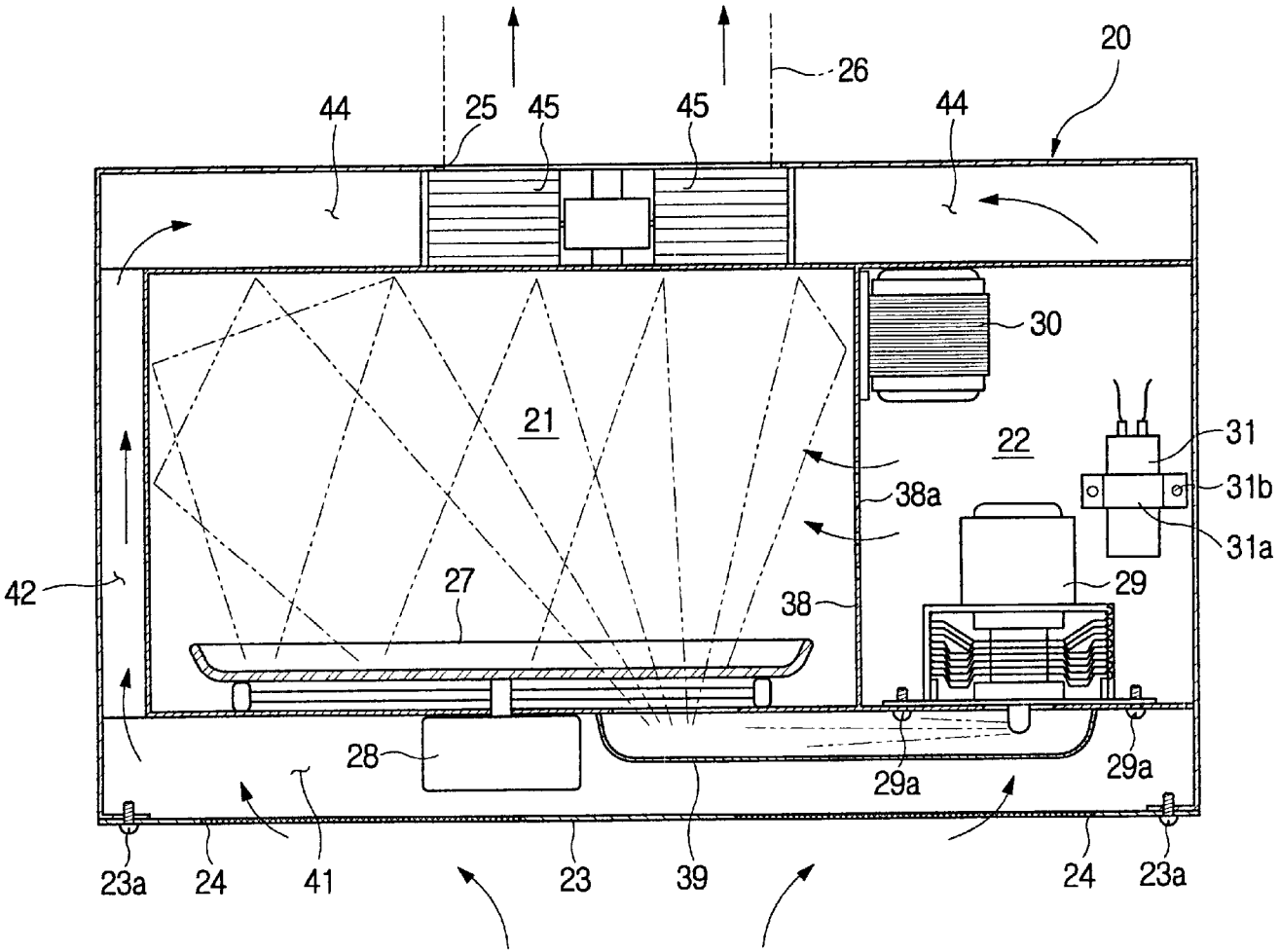
FIG. 2 is a front sectional view showing the overall construction of a wall-mounted microwave oven according to an embodiment of the present invention.
Figure 3:
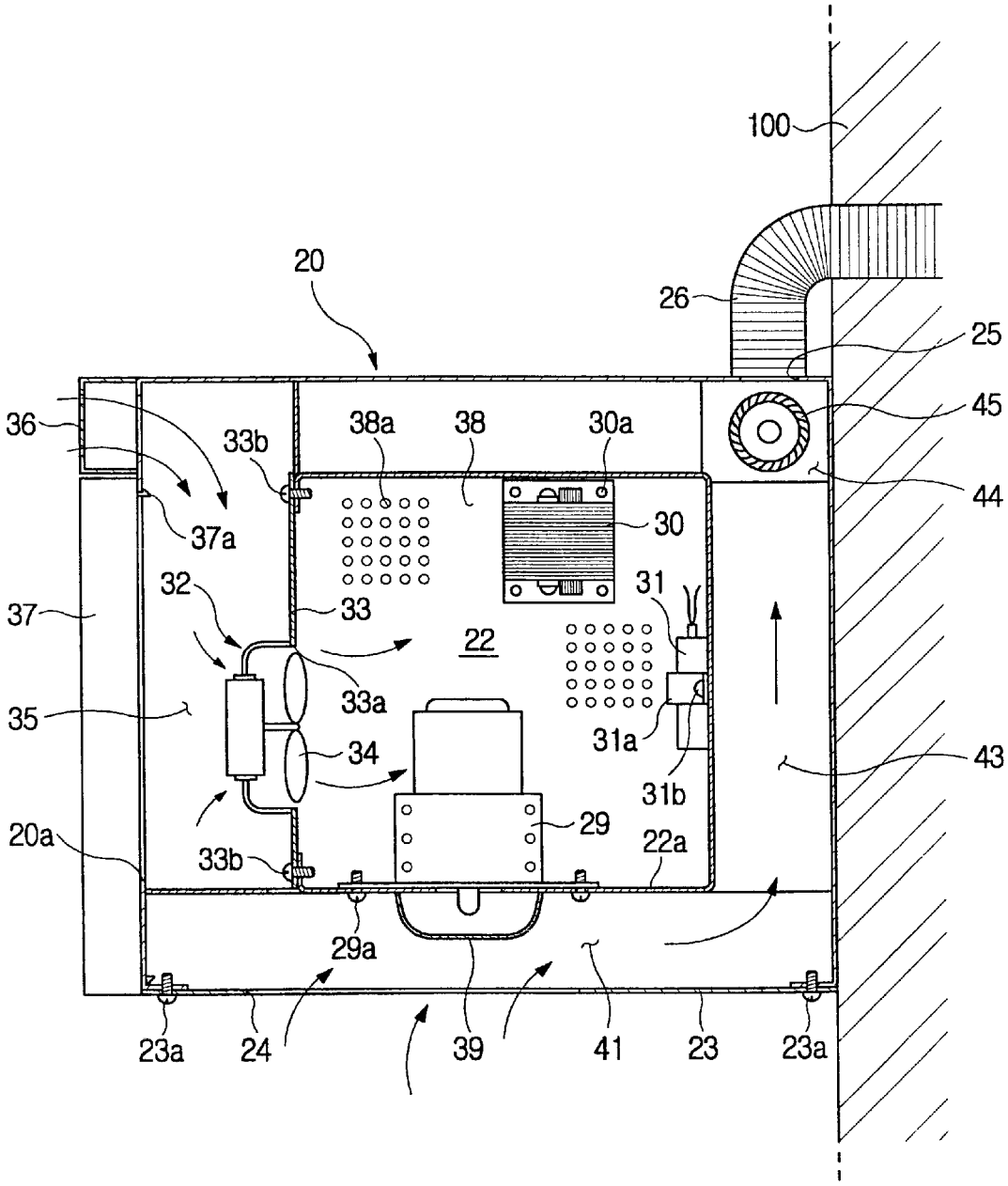
FIG. 3 is a side sectional view of the construction of a machine room of the wall-mounted microwave oven of FIG. 2.

FIGS. 2 and 3 show a wall-mounted microwave oven according to an embodiment of the present invention, where a rear surface of a body 20 is fixed to a wall 100 of a building at a position above, for example, an oven range (not shown). The body 20 is partitioned into a cooking cavity 21 and a machine room 22. An exhaust unit is provided at upper, lower, and both side portions of the body 20 so as to exhaust gas and smoke produced from an operation of the oven range to the atmosphere.

The exhaust unit includes a lower exhaust path 41, a side exhaust path 42, a rear exhaust path 43, an upper exhaust path 44, and an exhaust fan 45. The lower exhaust path 41 is formed in the body 20 under the cooking cavity 21 and the machine room 22. The side exhaust path 42 is formed at a side portion of the cooking cavity 21, while the rear exhaust path 43 is formed at a rear portion of the machine room 22. The side and rear exhaust paths 42 and 43 commonly communicate with the lower exhaust path 41. The upper exhaust path 44 is formed in the body 20 above the cooking cavity 21 and the machine room 22 so as to communicate with the side and rear exhaust paths 42 and 43. The exhaust fan 45 is mounted in the body 20 at a rear end of the upper exhaust path 44.

A cover plate 23 is attached to a lower end of the body 20 so as to be spaced apart from bottom surfaces of the cooking cavity 21 and the machine room 22, and form the lower exhaust path 41. An air inlet port 24 is formed on the cover plate 23 and sucks the gas and smoke produced from the oven range. An air outlet port 25 is formed on an upper portion of the body 20 and discharges the gas and smoke into the atmosphere using a blowing force of the exhaust fan 45. The air outlet port 25 is provided with a duct 26 which guides the gas and smoke from the body 20 to the atmosphere. The exhaust unit is designed so as to have the gas and smoke sucked into the body 20 through the air inlet port 24 of the cover plate 23, sequentially pass through the lower exhaust path 41, the side and rear exhaust paths 42 and 43, the upper exhaust path 44 and the exhaust fan 45, and discharged from the body 20 to the atmosphere, by an operation of the exhaust fan 45 through the duct 26.

A cooking tray 27 is rotatably set in the cooking cavity 21 and holds food thereon. A motor 28 which rotatably drives the cooking tray 27 may be installed outside a bottom surface of the cooking cavity 21.

A magnetron 29, a high voltage transformer 30, and a high voltage condenser 31 are installed in the machine room 22. The magnetron 29 feeds high-frequency electromagnetic waves to the inside of the cooking cavity 21. The high voltage transformer 30 provides a high voltage to the magnetron 29. In addition, various other electrical parts are installed in the machine room 22, including a cooling fan assembly 32 which cools the electrical parts in the machine room 22.

Figure 4:
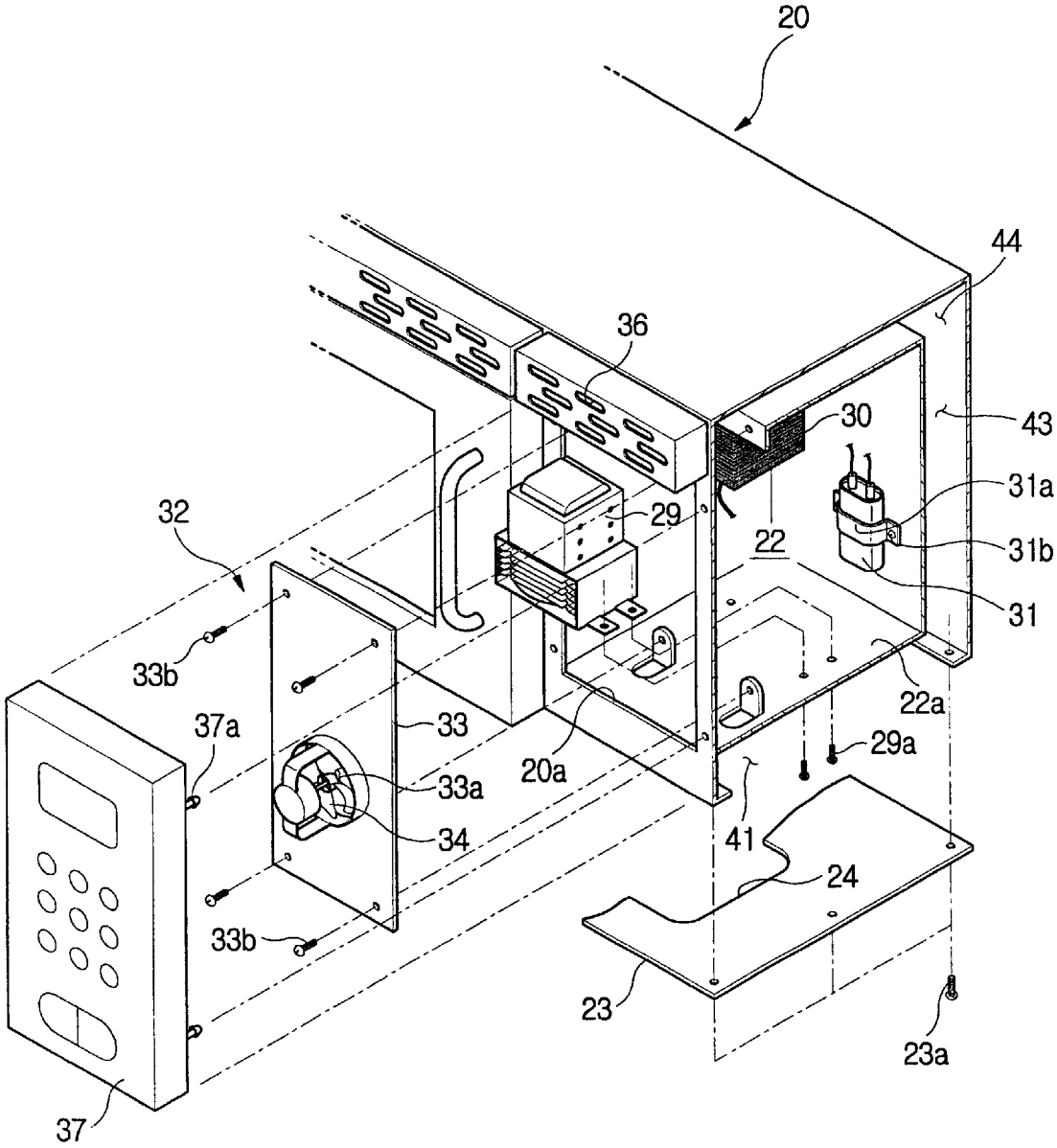
FIG. 4 is an exploded perspective view of the machine room of the wall-mounted microwave oven of FIG. 2.

As shown in FIGS. 3 and 4, a control panel 37 is mounted on the body 20 in front of the machine room 22, and is provided with a plurality of control buttons which control the operation of the wall-mounted microwave oven.

The cooling fan assembly 32 is installed in the machine room 22 and includes a support plate 33 and a cooling fan 34. The support plate 33 is set in the machine room 22, partitions the machine room 22 into front and rear chambers and is provided at its center with a through hole 33*a*. This support plate 33 is designed so as to have its upper and lower ends screwed to a bracket of the machine room 22 with fastening means such as setscrews 33*b*. The cooling fan 34 is set in the through hole 33*a* of the support plate 33, and the front chamber of the machine room 22 forms an air inlet chamber 35.

An air inlet port 36 is formed on a front surface of the body 20 above the control panel 37 and allows atmospheric air to flow into the machine room 22 as the cooling fan 34 is operated. That is, as the cooling fan 34 is operated, atmospheric air passing through the air inlet port 36 flows into the air inlet chamber 35 between the control panel 37 and the support plate 33, passes through the through hole 33*a* of the support plate 33, and then circulates in the machine room 22, so as to cool the various parts inside the machine room 22. The air flowing into the machine room 22 cools the interior of the machine room 22, and then flows into the cooking cavity 21 through a plurality of perforations 38*a* formed on a partition plate 38 set between the cooking cavity 21 and the machine room 22. After the circulation in the cooking cavity 21, the air is discharged to the atmosphere along with the gas and smoke through an additional exhaust path, thus ventilating the cooking cavity 21.

To allow the magnetron 29 to be repaired or replaced without removing the body 20 from the wall 100 of a building, the magnetron 29 is mounted on a bottom surface 22*a* of the machine room 22, the high-voltage transformer 30 is mounted in a upper portion of the machine room 22, and the high-voltage condenser 31 is mounted in the rear portion of the machine room 22. As shown in FIG. 2, a waveguide duct 39 extends from the bottom surface 22*a* of the machine room 22 at a position under the magnetron 29 to the bottom surface of the cooking cavity 21, and guides the high-frequency electromagnetic waves from the magnetron 29 to the cooking cavity 21.

The high-voltage transformer 30 is fixed, for example, by setscrews 30*a* to the partition plate 38 set between the machine room 22 and the cooking cavity 21. The high-voltage condenser 31 is mounted to a rear surface of the machine room 22 using, for example, a clip 31*a* and setscrews 31*b*, which mount the clip 31*a* to the rear surface of the machine room 22. The magnetron 29 is mounted on the bottom surface 22*a* of the machine room 22 by fastening means such as setscrews 29*a*.

According to an aspect of the present invention, the setscrews 29*a* which removably mount the magnetron 7 on the bottom surface 22*a* are manipulated from the outside of the bottom surface 22*a* of the machine room 22. That is, heads of the setscrews 29*a* are located outside of the machine room 22 so as to allow a user to remove the magnetron 29 from the machine room 22 by loosening the heads of the setscrews 29*a* at the outside of the lower surface 22*a* of the machine room 22 without removing the body 20 from the wall 100. To easily remove the magnetron 29 from the lower end of the body 20, the cover plate 23 can be detachably attached to the lower end of the body 20 using setscrews 23*a*, which are accessible from the outside of the body 20.

According to another aspect of the present invention, an opening (not shown), may be formed on the cover plate 23 to allow a user to remove the magnetron 29 from the machine room 22 at the outside of the lower end of the body 20 without detaching the cover plate 23 from the body 20. For example, an opening may be formed in the cover plate 23 at a position corresponding to each of the setscrews 29*a* so as to allow a fastening tool, such as a screwdriver, to reach the setscrews 29*a* after passing the openings.

Figure 5:
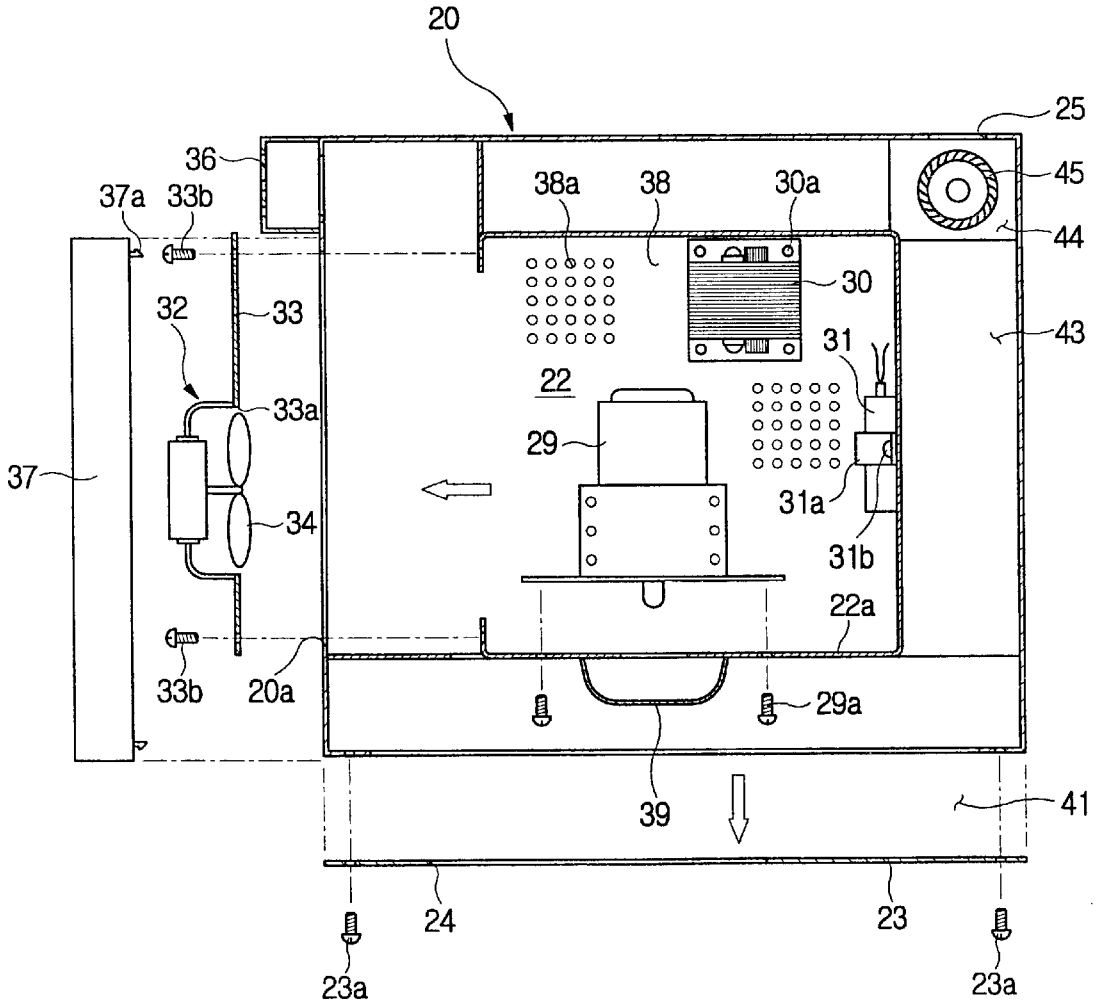
FIG. 5 is an exploded side sectional view illustrating a method of removing a magnetron from the machine room of the wall-mounted microwave oven of FIG. 2.

FIG. 4 shows an exploded perspective view of the machine room 22, and FIG. 5 shows an exploded side sectional view of the wall-mounted microwave oven of FIG. 2. To allow the user to take the magnetron 29 out from the machine room 22 after loosening the setscrews 29*a*, the control panel 37 is detachably mounted on the body 20 in front of the machine room 22. In addition, an opening 20*a* is formed on a front surface of the body 20 behind the control panel 37 so as to remove the magnetron 29 and the cooling fan assembly 32 from the machine room 22 through the opening 20*a*. The size of the opening 20*a* is larger than the magnetron 29 or the cooling fan assembly 32. The control panel 37 is mounted on the body 20, for example, using hooks 37*a* which are protrusively formed on an inner surface of the control panel 37 or by tightening setscrews thereon. The setscrews 33*b* which mount the upper and lower ends of the support plate 33*b* to the body 20 are also tightened or loosened at the outside of the front of the body 20, after removing the control panel 37 from the body 20.

With reference to FIGS. 4 and 5, an operation of replacing the magnetron 29 of the wall-mounted microwave oven of FIG. 2 will be described below.

As shown in FIG. 3, the wall-mounted microwave oven is mounted to the wall 100. To repair or replace the malfunctioning magnetron 29, the cover plate 23 is detached from the lower end of the body 20. Since there is no component under the cover plate 23, the setscrews 23*a* which attach the cover plate 23 to the body 20 are easily removed from the outside of the lower end of the body 20.

With the cover plate 23 removed from the body 20, the bottom surface of the machine room 22, as well as the setscrews 29*a*, are exposed to the outside. Accordingly, the setscrews 29*a* holding the magnetron 29 can be removed from the bottom surface of the machine room 22*a* by using a fastening tool, such as a screwdriver.

The control panel 37 is detached from the front surface of the body 20. Thereafter, the cooling fan assembly 32 is removed from the machine room 22, by using the fastening tool to loosen the setscrews 33*b* tightened to the upper and lower ends of the support plate 33 of the cooling fan assembly 32. The fastening tool can approach the cooling fan assembly 32 through the opening 20*a* which is formed on the front surface of the machine room 22. Next, the cooling fan assembly 32 and the magnetron 29 are taken out from the machine room 22 through the opening 20*a*. As described above, the wall-mounted microwave oven of the present invention allows the magnetron 29 to be removed from the machine room 22 without removing the body 20 from the wall 100 of a building, thus allowing a service person or a user to easily repair or replace the magnetron 29.

The process of installing the repaired magnetron or a new magnetron in the machine room 22 is carried out by performing the above-mentioned process in the reverse order. That is, the repaired or new magnetron is put into a predetermined position inside the machine room 22 through the opening 20*a* formed on the front surface of the machine room 22. The repaired or new magnetron is mounted on the bottom surface 22*a* of the machine room 22 by inserting and/or tightening the setscrews 29*a* at the outside of the bottom surface 22*a*. The cooling fan assembly 32 and the control panel 37 are sequentially installed in the machine room 22, and the cover plate 23 is screwed to the lower end of the body 20.

As described above, the present invention provides a wall-mounted microwave oven, which is designed so as to allow easy repair and/or replacement of parts, such as a magnetron that is removably mounted inside the wall-mounted microwave oven using setscrews accessible from the outside of a lower end of the wall-mounted microwave oven's body. Therefore, an operator can easily repair or replace the parts without removing the wall-mounted microwave oven from a wall of a building.

While a wall-mounted microwave oven has been described, it is understood that the present invention can be applied to microwave ovens not mounted to a wall and other household appliances, such as convection ovens and toast ovens, so as to easily repair and/or replace parts therein.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven, comprising:

a body which is mounted on a wall and partitioned into a cooking cavity and a machine room;

a magnetron which generates high-frequency electromagnetic waves and installed in the machine room;

a control panel which is detachably mounted on the body in front of the machine room, wherein the magnetron is mounted on a bottom surface of the machine room so as to be removable from the machine room without removing the body from the wall; and a plurality of fasteners which removably mount the magnetron and are accessible to be tightened or loosened from an outside of a lower end of the body so as to repair or replace the magnetron without removing the body from the wall.

2. The microwave oven according to claim 1, further comprising a cover plate which is detachably attached to a lower end of the body and spaced apart from the bottom surface of the machine room.

3. The microwave oven according to claim 2, wherein the cover plate includes openings formed at corresponding positions of the fasteners so as to allow the fasteners to be tightened or loosened without removing the cover plate.

4. The microwave oven according to claim 1, further comprising a waveguide duct which extends from the bottom surface of the machine room at a position under the magnetron to a bottom surface of the cooking cavity so as to guide the high-frequency electromagnetic waves to the cooking cavity.

5. The microwave oven according to claim 1, wherein the fasteners comprise setscrews including corresponding heads, which allow manipulation of the setscrews and are accessible from the outside of the lower end of the body.

6. A wall-mounted microwave oven comprising:

a body which is mounted on a wall and partitioned into a cooking cavity and a machine room;

a magnetron which generates high-frequency electromagnetic waves and installed in the machine room;

a control panel which is detachably mounted on the body in front of the machine room, wherein the magnetron is mounted on a bottom surface of the machine room so as to be removable from the machine room without removing the body from the wall;

a cooling fan assembly which is installed in the machine room and cools the machine room; and an opening which is formed on a front surface of the body and at a position behind the control panel, so as to allow machine room components including the cooling fan assembly and the magnetron to be removed from the machine room through the opening.

7. The microwave oven according to claim 6, further comprising fasteners which removably mount the magnetron and are accessible to be tightened or loosened from an outside of a lower end of the body so as to repair or replace the magnetron without removing the body from the wall.

8. The microwave oven according to claim 7, further comprising a cover plate which is detachably attached to the lower end of the body and spaced apart from the bottom surface of the machine room.

9. The microwave oven according to claim 8, wherein the cover plate includes open portions formed at corresponding positions of the fasteners so as to allow the fasteners to be tightened or loosened without removing the cover plate.

10. The microwave oven according to claim 9, wherein the fasteners comprise setscrews including corresponding heads, which allow manipulation of the setscrews and are accessible from the outside of the lower end of the body.

11. The microwave oven according to claim 10, further comprising a waveguide duct which extends from the bottom surface of the machine room at a position under the magnetron to a bottom surface of the cooking cavity so as to guide the high-frequency electromagnetic waves to the cooking cavity.

12. A microwave oven comprising:

a body which is partitioned into a cooking cavity and a machine room;

machine room components which are detachably installed in the machine room including a magnetron which generates high-frequency electromagnetic waves, a high-voltage transformer, a cooling fan and a high-voltage condenser;

a control panel detachably mounted on the body in front of the machine room;

an opening formed on a front surface of the body and behind the control panel, wherein the opening and detachably mounted control panel allow one or more of the machine room components including the magnetron, to be repaired or replaced through the opening; and a plurality of fasteners which removably mount the one or more of the machine room components including the magnetron, and are accessible to be tightened or loosened from an outside of a lower end of the body.

13. The microwave oven according to claim 12, further comprising a cover plate which is detachably attached to the lower end of the body and spaced apart from a bottom surface of the machine room.

14. The microwave oven according to claim 13, wherein the cover plate includes open portions formed at corresponding positions of the fasteners so as to allow the fasteners to be tightened or loosened without removing the cover plate.

15. The microwave oven according to claim 14, further comprising a waveguide duct which extends from the bottom surface of the machine room at a position under the magnetron to a bottom surface of the cooking cavity so as to guide the high-frequency electromagnetic waves to the cooking cavity.

16. The microwave oven according to claim 15, wherein the microwave oven is a wall-mounted microwave oven, which exhausts gas and smoke produced below the microwave oven.

17. The microwave oven according to claim 12, wherein the microwave oven is a wall-mounted microwave oven, which exhausts gas and smoke produced below the microwave oven.

18. The microwave oven according to claim 17, further comprising a cover plate which is detachably attached to a lower end of the body and spaced apart from a bottom surface of the machine room, so as to allow repair or replacement of the machine room components without removing the wall-mounted microwave oven from a wall.

19. A microwave oven comprising:

an oven body which is partitioned into a cooking cavity and a machine room, and mounted on a wall;

a magnetron which generates microwaves to cook food and installed in the machine room;

a control panel detachably mounted on an area corresponding to a front of the machine room;

an opening formed behind the detachably mounted control panel, and having a clearance which allows the magnetron to be repaired or replaced through the opening without removing the oven body from the wall; and a plurality of fasteners which removably mount the magnetron and are accessible to be tightened or loosened from an outside of a lower end of the oven body in the machine room.

* * * * *